United States Patent [19]

Long

[11] Patent Number: 4,802,672

[45] Date of Patent: Feb. 7, 1989

[54] SET OF GOLF IRONS

[75] Inventor: D. Clayton Long, Albany, Ga.

[73] Assignee: MacGregor Golf Company, Albany, Ga.

[21] Appl. No.: 66,077

[22] Filed: Jun. 24, 1987

[51] Int. Cl.[4] ..... A63B 53/00

[52] U.S. Cl. ..... 273/77 A; 273/167 H; 273/169; 273/175

[58] Field of Search ..... 273/77 A, 167 J, 175, 273/169, 167 H, 170, 171, 172, 77 R

[56] References Cited

U.S. PATENT DOCUMENTS

| | | | |
|---|---|---|---|
| 1,089,881 | 3/1914 | Taylor | 273/174 |
| 1,617,090 | 2/1927 | Worthington | 273/171 |
| 1,695,598 | 12/1928 | MacClain | 273/167 R |
| 2,332,342 | 10/1943 | Reach | 273/171 |
| 2,447,967 | 8/1948 | Stone | 273/77 A |
| 2,973,581 | 3/1961 | Rhodehamel | 273/77 A |
| 3,984,103 | 10/1976 | Nix | 273/77 A |

FOREIGN PATENT DOCUMENTS

| | | | |
|---|---|---|---|
| 4301 | of 1912 | United Kingdom | 273/167 J |

OTHER PUBLICATIONS

"Golf Digest", May 1977, p. 109.

*Primary Examiner*—George J. Marlo
*Attorney, Agent, or Firm*—Jones, Askew & Lunsford

[57] ABSTRACT

There is disclosed a set of golf irons which have progressively decreasing displacements between the axis of the shaft and the center of mass projected to the horizontal plane beginning with the long irons and progressing to the short irons. Each iron in the set also has a support column behind the striking face, parabolic shaped horizontal grooves in the striking face, and a flat segment on the sole.

4 Claims, 8 Drawing Sheets

SET OF GOLF IRONS

BACKGROUND OF THE INVENTION

This invention relates generally to golf irons and more particularly concerns a set of golf irons including long distance irons and short distance irons which set, beginning with the long irons, has progressively decreasing displacement between the center line of the hosel and the center of mass of the head. In addition each iron within the set has a support column in a cavity behind the center of mass of the head, a pattern of horizontal face grooves with parabolic sides which pattern of grooves is configured to disguise the progressive displacement, and a planar segment on the sole to cause the head to sit squarely at address.

Golf irons typically include a set of eleven irons, numbered one (long) through nine (short), a pitching wedge, and a sand wedge. Each iron comprises a head including a hosel and a shaft which is attached to the head by fitting the shaft into the bore of the hosel. The hosel is attached to and is integral with the head. The head includes a heel, a bottom sole, a toe, a planar striking face, and a backside.

The eleven irons of a set conventionally have varying degrees of loft angle and lie angle. The loft angle of an iron is the angle between a vertical plane, which includes the shaft, and the plane of the striking face of the iron. The lie angle of an iron is the angle between the shaft and the ground (horizontal plane) when the tangent to the sole directly under the center of mass is in the horizontal plane and when the shaft lies in a vertical plane.

The loft angle, as the name suggests, determines how much loft is imparted to the ball when it is struck by the tilted striking face. The lie angle of the iron assures that, when swung properly, the sole of the iron will contact the ground evenly so that the striking face will not tend to twist inwardly or outwardly.

Although the loft and lie angles may vary slightly between different brands of iron, the loft and lie angles (in degrees) for irons generally are shown in Table 1.

TABLE 1

| | (Prior Art) | |
|---|---|---|
| Iron # | Loft Angle | Lie Angle |
| 1 | 16 | 57 |
| 2 | 18 | 57.5 |
| 3 | 21 | 58 |
| 4 | 24 | 59 |
| 5 | 27.5 | 60 |
| 6 | 32 | 60.5 |
| 7 | 37 | 61 |
| 8 | 41 | 61.5 |
| 9 | 45 | 62 |
| Pitching Wedge | 50 | 63 |
| Sand Wedge | 58 | 63 |

For any set of golf irons, it is important that for a consistent swing, the iron impart consistent loft and distance to the ball. It is also important that when properly swung, the iron produces a consistent shot without tendency to hook or slice.

Even when conventional irons are swung consistently, such irons vary in their loft change at impact due to centrifugal forces. The prior art teaches that that tendency to change loft can be compensated for by providing a set of golf irons which have progressively decreasing offsets, beginning with the long iron (#1) and progressively decreasing toward the short irons (sand wedge). The offset is the distance between the leading edge of the face of the iron and the axis of the shaft in the horizontal direction into the striking face of the iron (Y-direction). For long irons, the leading edge of the face actually trails the axis of the shaft. For short irons, the leading edge of the face actually proceeds the axis of the shaft. The offset is related to the distance by which the center of mass of the head trails the axis of the shaft. The center of mass for short irons trails the axis of the shaft by more than the center of mass for long irons trails the axis of the shaft.

Because of the offset and the related position of the center of mass, the centrifugal forces that result about the center of mass of the head when the iron is swung tend to cause the iron to increase its loft angle as the shaft bends and to cause the head to twist about the shaft axis toward a more closed face position as the face of the iron comes into contact with the ball. By progressively varying the offset from the long irons to the short irons, an appropriate degree of consistent loft change can be achieved from iron to iron.

Offset in a conventional set of irons also tends to induce a twisting action at the head which closes the face and produces a hook. That twisting action is greater for the short irons with their larger head mass than for the long irons with their smaller head mass.

It is also well known in the art to design golf irons with the majority of the weight concentrated at the heel and toe of the iron in order to increase the moment of inertial about the center of mass of the irons so that the head will not tend to twist if the ball is truck slightly off center. Such weight distribution is generally accomplished by providing a cavity in the backside of the iron centered about the center of mass so that the remaining mass of the head of the iron is concentrated at the heel and toe. Because of the cavity in the backside of the iron, the iron has a very thin blade at the center of mass directly behind the striking face. Consequently, when a ball is struck with such a thin bladed iron, the iron produces a hollow sound which is considered objectionable by many golfers.

In a conventional set of irons each iron has a number of horizontal grooves extending across the planar striking face. The grooves provide escape channels for water so that the ball will not hydroplane up the planar striking face and thereby not take any back spin from the iron. When the striking face fails to impart back spin to the ball, the ball will flutter (like a knuckleball), will tend to fly farther than anticipated, and will not hold (bite) the playing surface upon landing. Conventionally, the grooves have either been V-shaped in cross section or have been boxshaped in cross section. In each case, the junction between the planar striking face and the sides of the grooves has been generally sharp which tends to scuff the balls as the striking face imparts spin to the ball. Also, the V-shaped groove and the box-shaped groove do not provide maximum cross sectional area for handling the volume of water that may be present between the striking face and the ball.

Conventional irons generally have a rounded convex sole. When conventional irons are grounded at address, the iron may not be properly aligned both heel to toe or face to backside. Such improper address, may effect the golfer's subsequent striking of the ball.

SUMMARY OF THE INVENTION

It is therefore an object of the invention to provide a set of golf irons including long irons and short irons which have a progressively decreasing offset, beginning with the long irons, and a progressively decreasing displacement, beginning with the long irons, where the displacement is measured along the ground (horizontal plane) between the intersection of the ground and a line through the center of mass projected perpendicularly toward the leading edge of the face and the intersection of the ground and the axis of the shaft projected toward the ground.

It is a related object of the present invention to provide a set of golf irons in which the rotational moment of inertia about the axis of the shaft of each iron is essentially equal to the moments of inertia for the other irons in the set.

It is likewise an object of the present invention to provide a set of golf irons in which each iron has a support column in the backside cavity which is aligned with the center of mass and the blade center line to reduce the objectionable hollow sound.

It is further an object of the present invention to provide a set of irons in which each iron has a pattern of horizontal grooves and each groove has an improved cross sectional configuration to provide an additional cross sectional area for channeling away water during impact and for minimizing scuffing of the ball upon impact.

It is additionally object of the present invention to provide a set of irons with progressive displacement wherein each iron has a pattern of horizontal grooves in the face which pattern is configured to disguise the progressive displacement.

It is additionally an object of the present invention to provide a set of irons in which each iron has a planar segment on its sole to assist in grounding the iron squarely at address.

Other objects and advantages of the present invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
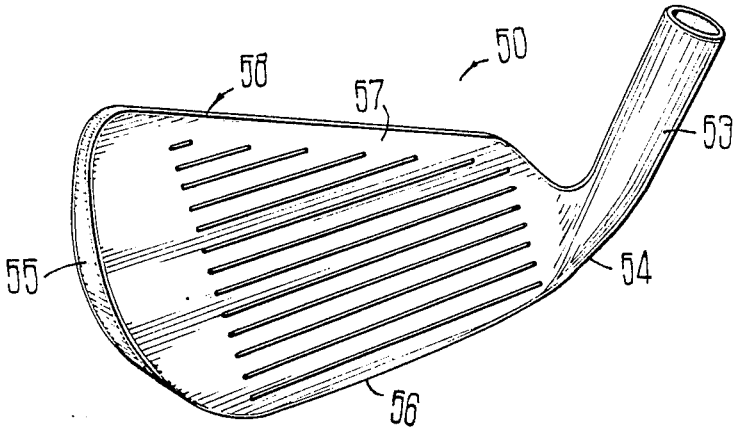
FIG. 1 is a front perspective of a #5 golf iron of the present invention.

Turning to FIG. 1 there is shown the head of a #5 golf iron 50 embodying the present invention. The #5 golf iron shown in FIG. 1 is one of a set of golf irons shown in segmented elevation views in FIGS. 3–13 including a #1 golf iron 10, a #2 golf iron 20, a #3 golf iron 30, a #4 golf iron 40, the #5 golf iron 50, a #6 golf iron 60, a #7 golf iron 70, a #8 golf iron 80, a #9 golf iron 90, a pitching wedge golf iron 100, and a sand wedge golf iron 110.

The common features of each of the golf irons shown in FIGS. 3—13 are identified by a two-digit number in which the first digit identifies the iron number and the second digit identifies the feature. For example, the #1 golf iron 10 has a shaft 11. The shafts for the other golf irons are identified as 21 for iron #2, 31 for iron #3, and so on ending with 101 identifying the shaft of the pitching wedge and 111 identifying the shaft of the sand wedge. The common features will be described in connection with the #5 golf iron shown in FIGS. 7A and 7B. Particularly, the #5 iron 50 has a head 58 with an integral hosel 53, a heel 54, a toe 55, a sole 56, and a striking face 57. A shaft 51 is inserted into the hosel 53 and has a shaft axis 52. The iron head 58 has a center of mass 59. The centers of mass 19, 29, 39, 49, 59, 69, 79, 89, 99, 109, and 119 for each iron in the set are spaced vertically by distances 271–281 above the horizontal plane 135 as set out in Table 2 below. It should be noted in FIGS. 3–13 that the centers of mass are shown projected into the vertical plane 450 (FIG. 19) which includes the axis (eg. 22, 52, or 102) of the shaft and not in the segmented and rotated plane of the iron's face.

Figure 19:
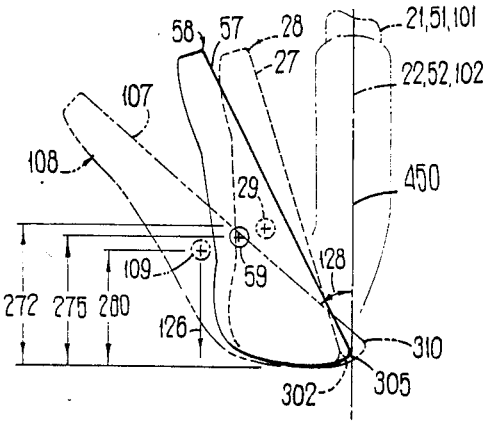
FIG. 19 shows the views of FIGS. 16, 17, and 18 super-imposed on each other for the purposes of illustrating offset.

Consequently, the vertical distances 272, 275, and 280 are measured from the ground plane 135 to the heights of the centers of mass 29, 59, and 109 in the vertical plane 450 (FIG. 19).

TABLE 2

| Iron # | Center of Mass Vertical Elevation (inches) |
|---|---|
| 1 | .798 |
| 2 | .795 |
| 3 | .793 |
| 4 | .790 |
| 5 | .787 |
| 6 | .785 |
| 7 | .782 |
| 8 | .779 |
| 9 | .776 |
| Pitching Wedge | .774 |
| Sand Wedge | .774 |

In order to understand one aspect of the present invention, it is necessary to understand that some sets of conventional golf irons have progressively decreasing offsets from the long irons to the short irons. The offset of a golf iron is defined as the horizontal distance between the leading edge of the face of the golf iron and the axis of the shaft.

Figure 16:
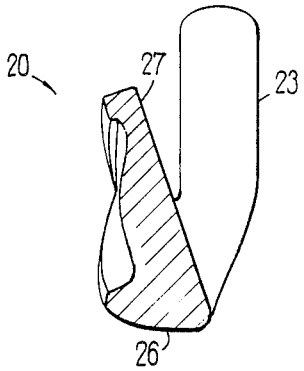
FIG. 16 is a toe end section view of a #2 golf iron as seen along line 16—16 of FIG. 4.
Figure 17:
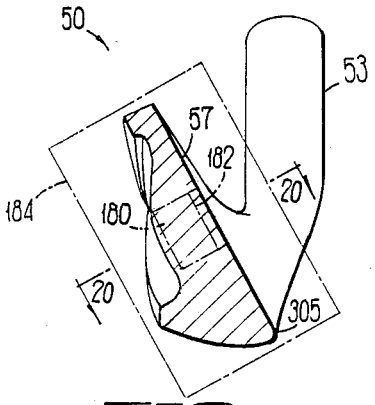
FIG. 17 is a toe end section view of a #5 golf iron as seen along line 17—17 of FIG. 7A.
Figure 18:
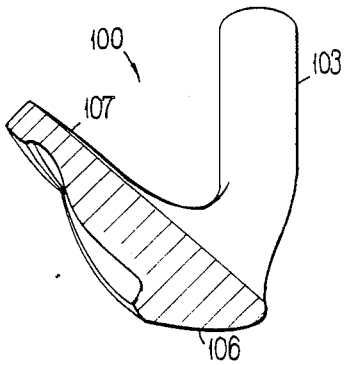
FIG. 18 is a toe end section view of a pitching wedge golf iron as seen along line 18—18 of FIG. 12.

Turning to FIGS. 16, 17, and 18, there is shown the cross-sections for the #2 iron, #5 iron, and pitching wedge iron. The profiles for the #2 iron, #5 iron, and pitching wedge are superimposed on each other in FIG. 19 and are oriented so that the shaft axes 22, 52, and 102, coincide and provide a vertical reference for gauging the offset of each club. The three clubs respectively have striking faces 27, 57, and 107 with leading edges 302, 305, and 310. In addition, each of the clubs respectively has a center of mass 29, 59, and 109. As can be clearly seen, the #2 iron 20 has its leading edge 302 behind the vertical reference 22, 52, and 102 in the horizontal direction. Because the leading edge 302 of the #2 iron 20 trails the vertical reference of the shaft axes (22, 52, 102), the #2 iron is said to have a negative offset. By contrast, the pitching wedge 100 has its leading edge 310 in front of the vertical reference of the shaft axes (22, 52, 102) in the horizontal direction so that it is said to have a positive offset. The #5 iron 50 typically has its leading edge 305 essentially in line with the vertical reference (22, 52, 102) established by the shaft axes thereby having a neutral or very close to neutral offset. The irons of the present invention, which have the loft and lie angles shown in Table 1, have an offset in accordance with the following Table 3.

TABLE 3

| Iron # | Offset (Inches) |
|---|---|
| 1 | −0.103 |
| 2 | −0.082 |

TABLE 3-continued

| Iron # | Offset (Inches) |
|---|---|
| 3 | −0.061 |
| 4 | −0.039 |
| 5 | −0.018 |
| 6 | +0.003 |
| 7 | +0.024 |
| 8 | +0.046 |
| 9 | +0.076 |
| Pitching Wedge | +0.088 |
| Sand Wedge | +0.099 |

The offsets of the irons of the present invention illustrated in FIG. 19 are in general conventional. The offset as previously noted helps compensate for centrifugal forces because of the distance between the axis of the shaft and the center of mass of the head. As the golf iron is swung forward, the centrifugal force on the center of mass of the club head pulls the center of mass downward as indicated by arrow 126 in FIG. 19 for the pitching wedge 100. Consequently, the flex in the shaft 101 causes the loft angle 128 between the face 107 and the axis 102 of the shaft 101 to increase thereby imparting a greater loft and therefore less distance to the golf ball.

It must also be appreciated in connection with the offset that during the normal swing of a golf iron, the face of the iron at the back swing is open 90° to the intended line of flight of the ball. As the golfer swings forward the golfer's wrist action causes the head to rotate 90° about the axis of the shaft so that at the moment of impact, the face of the iron in the forward direction is perpendicular to the intended line of flight. During the course of that rotation, the angular acceleration about the shaft axis is constant for each iron in the set. Therefore it is desirable that the rotational moments of intertia about the shaft axis be constant from iron to iron in the set. The constant moments of inertia from iron to iron means that the same amount of rotational effort exerted by the golfer produces the same amount of head rotation.

Figure 7B:
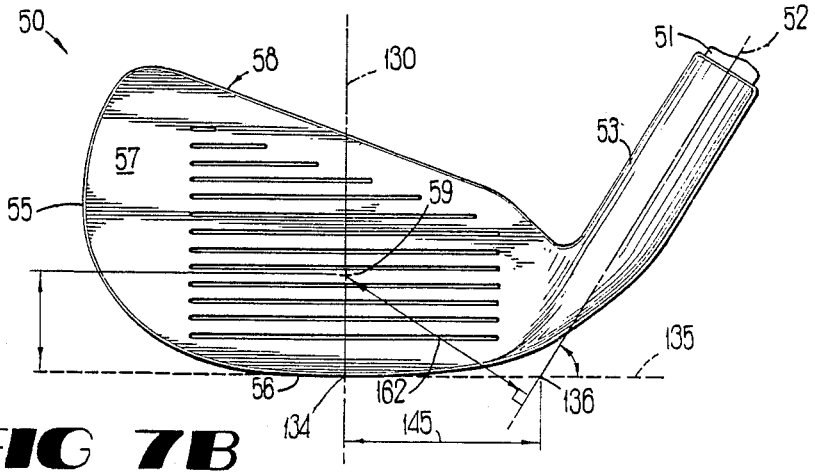
FIG. 7B is a true front elevation view of a #5 golf iron of the present invention with the hosel in the vertical plane and the face in the plane defined by its loft angle.
Figure 6:
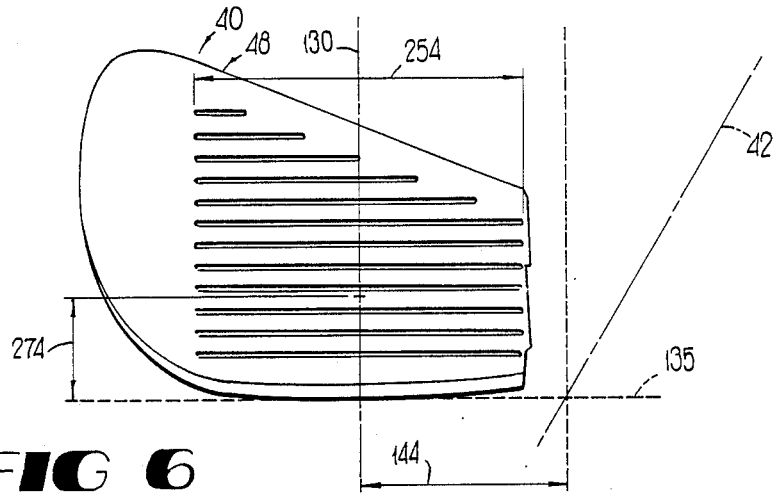
FIG. 6 is a segmented front elevation view of a #4 golf iron of the present invention.
Figure 7A:
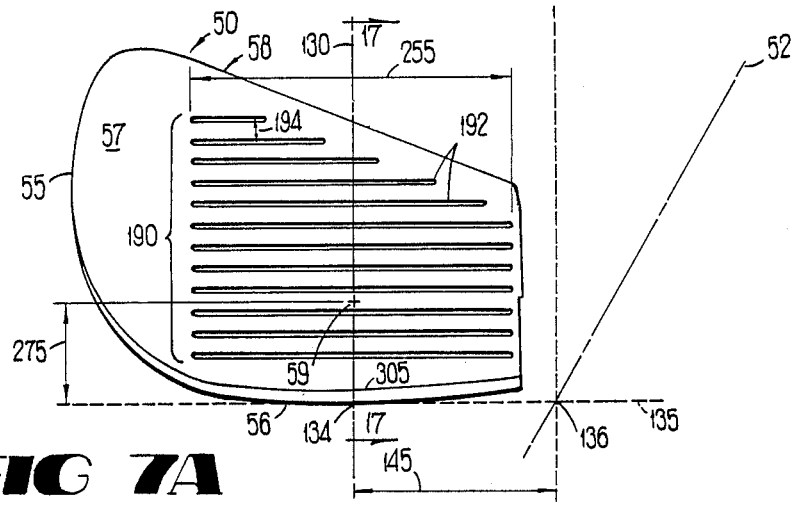
FIG. 7A is a segmented front elevation view of a #5 golf iron of the present invention.
Figure 8:
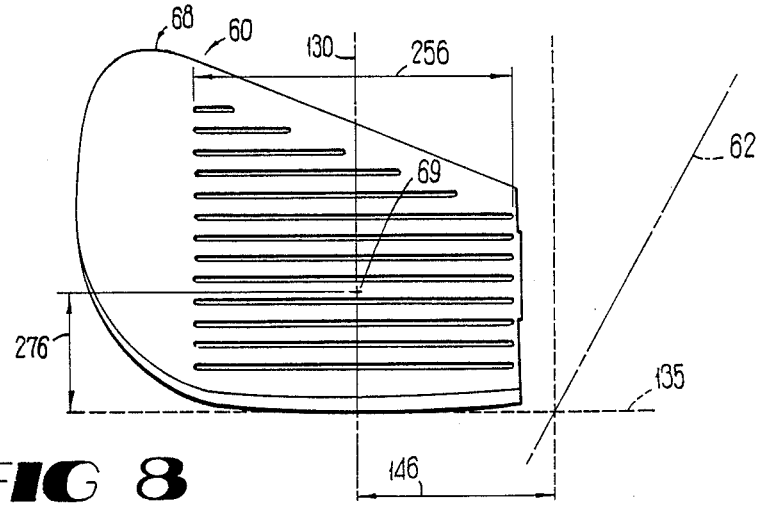
FIG. 8 is a segmented front elevation view of a #6golf iron of the present invention.
Figure 9:
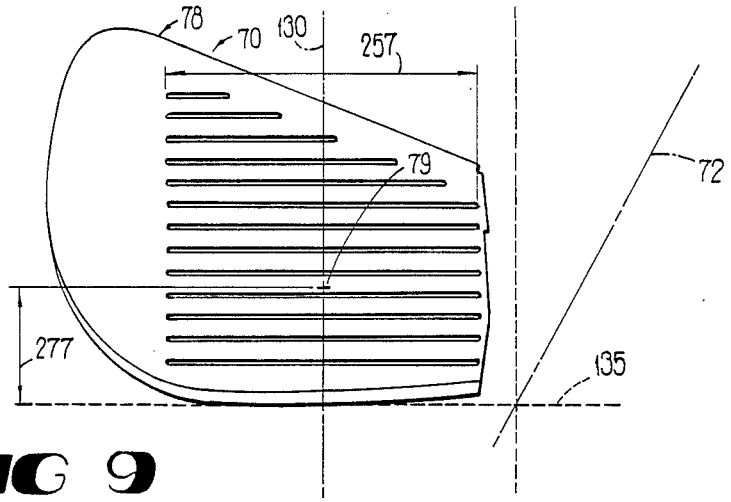
FIG. 9 is a segmented front elevational view of a #7golf iron of the present invention.
Figure 10:
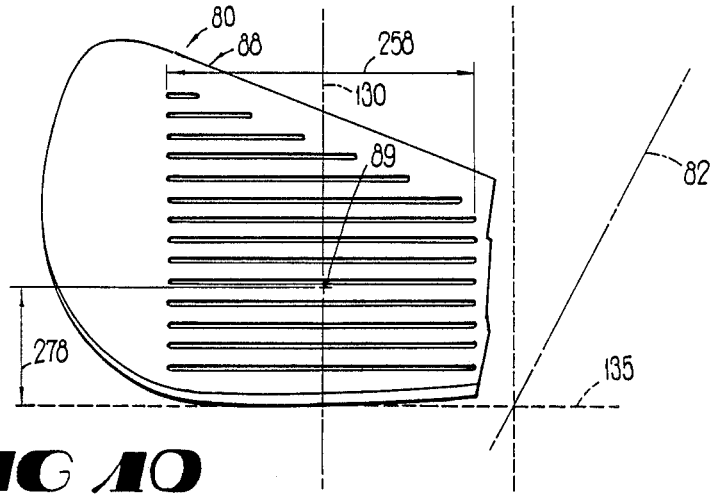
FIG. 10 is a segmented front elevation view of a #8 golf iron of the present invention.
Figure 11:
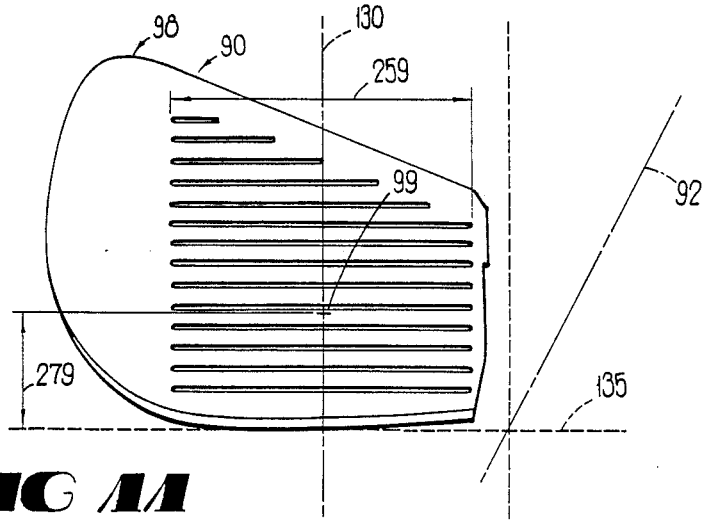
FIG. 11 is a segmented front elevation view of a #9golf iron of the present invention.

With reference to the #5 iron 50 in FIGS. 7A and 7B, a line 130, which is the center line of the face on each iron, intersects the ground or horizontal plane 135 at a point 134. The line 130 is essentially perpendicular to the leading edge of each iron and is aligned with the center of mass of each iron. Likewise, a projection of the shaft axis 52 intersects the horizontal plane 135 at a point 136. The distance 145 along the horizontal plane between the points 134 and 136 is the displacement between the center of mass and the axis of the shaft. In a conventional set of golf irons the displacment is the same for each iron in the set. In accordance with the present invention, however, each iron has a different displacement. Referring to FIGS. 3–13, the #1 iron has a displacement 141, the #2 iron has a displacement 142, the #3 iron has a displacement 143, the #4 iron has a displacement 144, the #5 iron has a displacement 145, the #6 iron has a displacement 146, the #7 iron has a displacement 147, the #8 iron has a displacement 148, the #9 iron has a displacement 149, the pitching wedge has a displacement 150, and the sand wedge has a displacement 151. The preferred displacements for a set of irons made in accordance with the present invention are set forth in Table 4.

TABLE 4

| Iron # | Displacement (Inches) |
|---|---|
| 1 | 1.5 |

TABLE 4-continued

| Iron # | Displacement (Inches) |
|---|---|
| 2 | 1.4715 |
| 3 | 1.4433 |
| 4 | 1.3879 |
| 5 | 1.3336 |
| 6 | 1.3068 |
| 7 | 1.2804 |
| 8 | 1.2541 |
| 9 | 1.2282 |
| Pitching Wedge | 1.1769 |
| Sand Wedge | 1.1769 |

The displacements shown in Table 4 result from establishing a starting reference with the #1 long iron (FIG. 3) which in one conventional embodiment has a displacement 141 of 1.5 inch and a lie angle 139 of 57° (Table 1). The shaft axis 12 intersects line 130 at a point 137. By rotating the shaft axis 12 counter clockwise in a vertical plane about the point 137 for the selected lie angles (Table 1) for the rest of the irons in the set, the other displacements 142–151 are determined at the horizontal plane 135 for each lie angle for each iron. If the lie angles are adjusted to accommodate a manufacturer's preference, the displacements should be changed accordingly.

In accordance with the present invention, I have discovered that by setting the displacements as set forth in Table 4, I have in essence equalized the rotational moment of inertia about each shaft axis for each of the irons. The equalization of the moment of inertia from iron to iron assures that for a consistent rotational effort by the golfer in bringing the face from 90° open to perfectly perpendicular at the moment of contact during the forward swing, the golfer should experience the same moment of inertia for each head regardless of the mass of the head.

With reference to the #5 iron 50 shown in FIG. 7B for example, the rotational moment of inertia is related to the mass of the head and the perpendicular distance 162 from the shaft axis 52. It should be understood that the distance 162 shown in FIG. 7B is not a true representation because the center of mass is displaced into the plane of the drawing. For the #5 iron, the perpendicular distance 162 is 1.5991 inch, and the mass of the head 50 is 251 gms. The rotational moment of interia about the shaft axis 52 can be calculated for each iron by the formula:

$$I_y = \frac{1}{12} M(B^2 + 4\,(2L)^2)$$

where M is the mass, L is the distance 162, and B is the average thickness of the head (equal to approximately 0.4 inch for each iron). The golf irons shown in FIGS. 3–13, having the loft angles, the offsets and the displacements disclosed in Tables 1, 3, and 4 have the following perpendicular distances, masses and moments of intertia shown in Table 5.

TABLE 5

| Iron # | Perpendicular Distance (inches) | Mass (grams) | Moment of Inertia (lb. ft. sec$^2$) |
|---|---|---|---|
| 1 | 1.7221 | 227 | $4.282 \times 10^{-4}$ |
| 2 | 1.7007 | 224 | $4.287 \times 10^{-4}$ |
| 3 | 1.6809 | 239 | $4.296 \times 10^{-4}$ |
| 4 | 1.6374 | 245 | $4.180 \times 10^{-4}$ |
| 5 | 1.5991 | 251 | $4.085 \times 10^{-4}$ |
| 6 | 1.5851 | 259 | $4.142 \times 10^{-4}$ |

TABLE 5-continued

| Iron # | Perpendicular Distance (inches) | Mass (grams) | Moment of Inertia (lb. ft. sec$^2$) |
|---|---|---|---|
| 7 | 1.5787 | 265 | $4.204 \times 10^{-4}$ |
| 8 | 1.5699 | 270 | $4.236 \times 10^{-4}$ |
| 9 | 1.5600 | 273 | $4.261 \times 10^{-4}$ |
| Pitching Wedge | 1.5798 | 279 | $4.432 \times 10^{-4}$ |
| Sand Wedge | 1.5798 | 285 | $4.559 \times 10^{-4}$ |

It can be seen from Table 5, except for the sand wedge, the amounts of inertia for the irons in the set are approximately equal within less than 10%. It is believed that variations of as much as 17% will still produce the benefits of the invention. The variation is calculated by determining the maximum difference in the moments of inertia between any of the irons in the set (except for the sand wedge) and dividing the difference by the lowest moment of inertia. By progressively varying the iron displacements to provide an equal rotational moment of inertia about the shaft axis for each iron in the set, the tendency of progressively offset irons to rotate inconsistently can be overcome.

Figure 2:
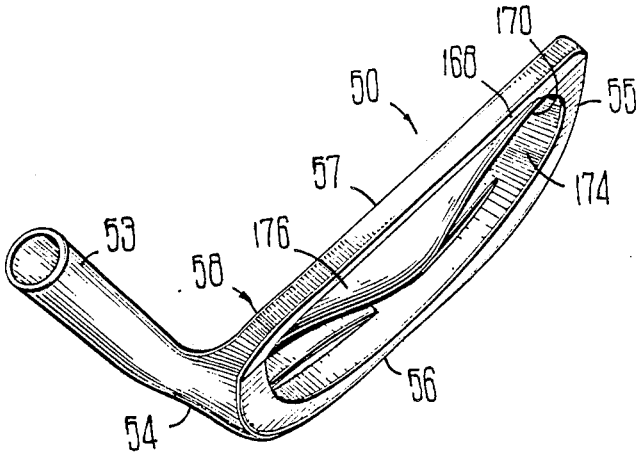
FIG. 2 is a rear perspective of a #5 golf iron of the present invention.
Figure 3:
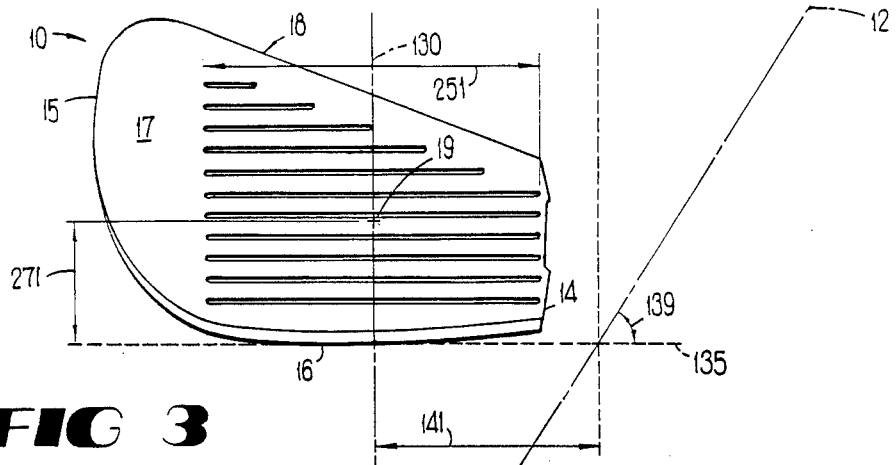
FIG. 3 is a segmented front elevation view of a #1 golf iron of the present invention with the hosel in vertical elevation and with the face of the iron rotated toward the vertical plane.
Figure 4:
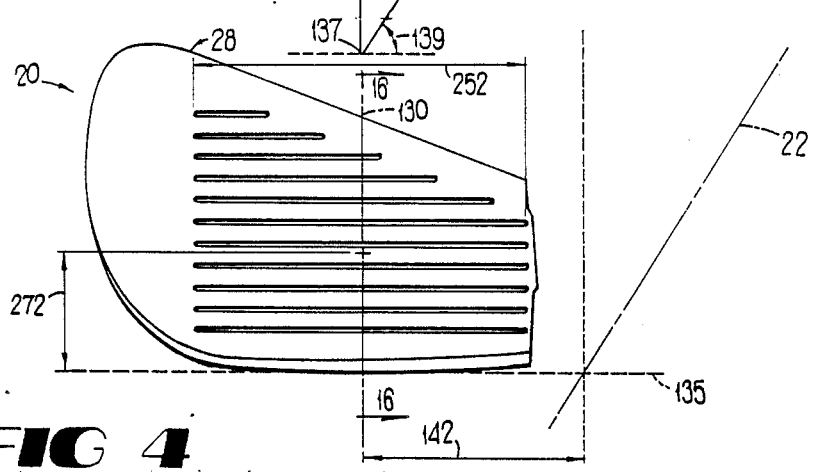
FIG. 4 is a segmented front elevation view of a #2 golf iron of the present invention.
Figure 5:
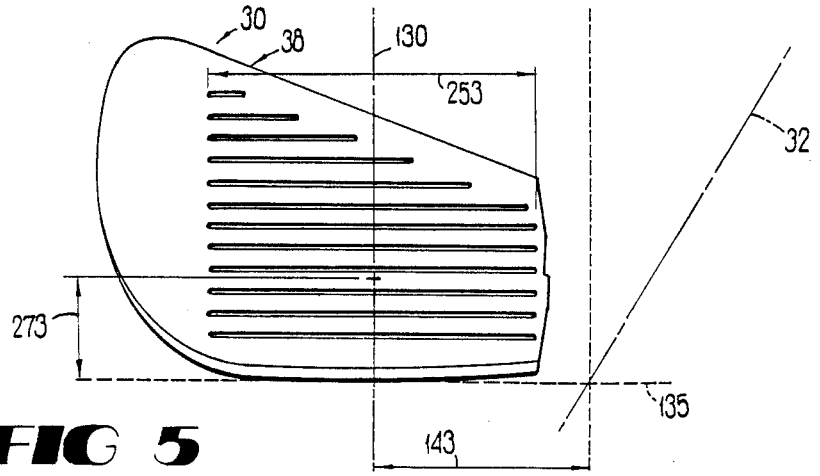
FIG. 5 is a segmented front elevation view of a #3 golf iron of the present invention.
Figure 12:
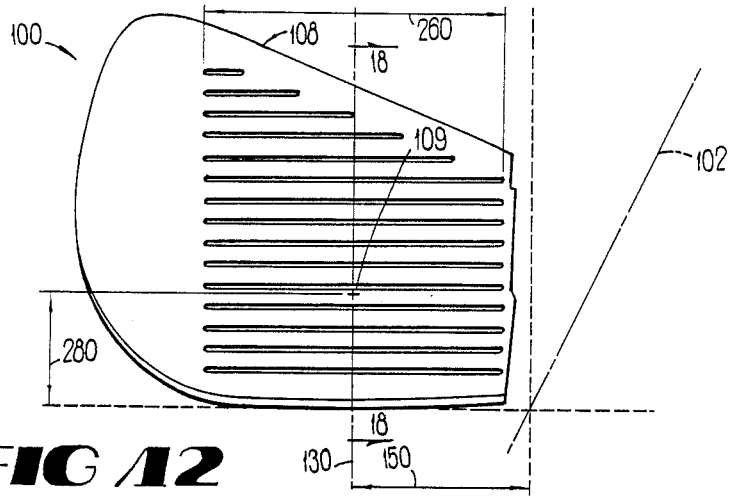
FIG. 12 is a segmented front elevation view of a pitching wedge.
Figure 13:
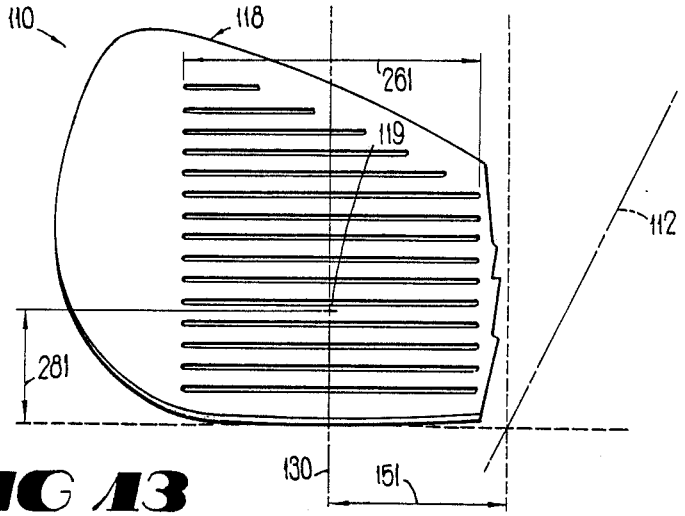
FIG. 13 is a segmented front elevation view of a sand wedge golf iron of the present invention.
Figure 14:
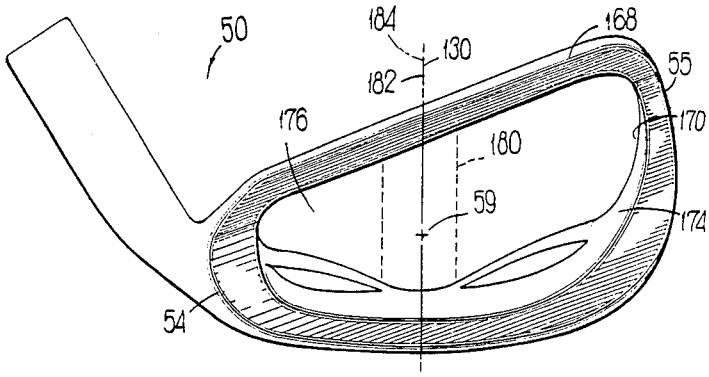
FIG. 14 is a back elevation view of a #5 golf iron of the present invention.
Figure 15:
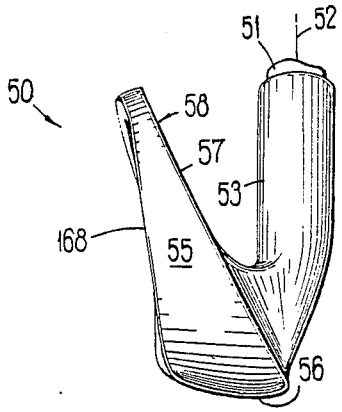
FIG. 15 is a toe end view of a #5 golf iron of the present invention.

In accordance with another aspect of the present invention, each iron of the set of irons has a reinforcing column behind the center of mass to reinforce the blade of the golf iron and to reduce any hollow or ringing sound that may result. With reference to FIGS. 2 and 14, the #5 golf iron 50, which is illustrative of all of the irons in the set, has a back side of 168 which has a cavity 170 formed therein. The cavity 170 is for the purpose of distributing the majority of the mass of the golf iron at the heel 54 and the toe 55 to insure a relatively high rotational moment of inertia about the face center line 130 which passes through the center of mass 59. For a conventional #5 iron, the cavity is of uniform depth centered about the center of mass. Consequently, such a conventional iron has a thin blade 469 (FIG. 20) behind the striking face adjacent the center of mass. Therefore, when a ball is hit with such a conventional iron, the thin blade tends to produce a hollow or ringing sound which many golfers find objectionable.

Figure 20:
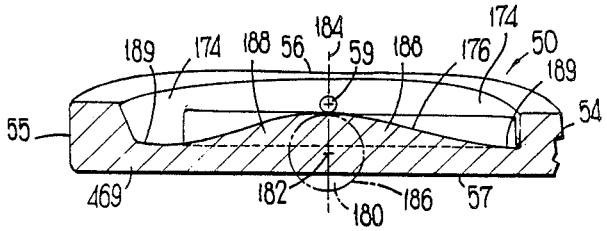
FIG. 20 is a section view as seen along line 20—20 of FIG. 17 showing internal detail of the support column of a #5 golf iron of the present invention.

In connection with the present invention, the cavity 170 which has side walls 174 and a floor surface 176. The floor surface 176 is elevated adjacent the center of mass as the result of the presence of a segment of a support column 180 (FIG. 20). The column 180 is positioned behind the striking face 57 (FIG. 17) and has a column axis 182 and a circumference 186. The axis 182 is parallel to the striking face 57 and lies within a plane 184 that is perpendicular to the planar face 57 and includes the center of mass 59. As can best be seen in FIG. 20, the floor surface 176 of the cavity 170 is defined by the circumference 186 of the column 180 and by fill material 188 which provides a smooth transition from the circumference 186 of the column to a thin periphery 189 adjacent the sides 174. The support column 180 with the fill material 188 provides support for the striking face at the center of mass to eliminate the hollow or ringing sound that ordinarily results from conventional golf irons which have cavities in the back side.

In accordance with a further object of the present invention, the planar striking face 57 of the #5 iron shown in FIG. 7A has a pattern 190 of horizontal grooves 192. The pattern 190 is configured so that the space 194 between the grooves 192 is equal for each iron in the set. The length 255 of the full length grooves 192 of the #5 iron occupies a majority of the length of face 57. The other irons likewise have lengths 251 to 261 for the #1 iron to the sand wedge. The groove lengths 251 to 261 vary in direct proportion to the displacements 141–151 of the centers of mass for each iron. The specific length of the full length grooves 192 is not critical as long as the grooves occupy a majority of the length of the face 57. What is important, however, is that for each iron in the set, the length of the grooves 192 is proportional to the displacement. By making the grooves 192 proportional in length to the displacement for each iron in the set, the pattern of grooves disguises the fact that the irons have the progressive displacement so that the golfer does not subconsciously compensate for the advantages that flow from the progressive displacement.

With continuing reference to FIG. 7A, the horizontal groove pattern 190 assures that the ball when struck by the inclined face 57 takes on back spin. Back spin assures that the ball flies true and that upon landing holds the playing surface. If under wet playing conditions the horizontal grooves are not present, moisture between the ball and the striking face will cause the ball to hydroplane up the incline face 57 without taking on any substantial back spin. Consequently, the ball will fly erratically, like a knuckle ball, will fly longer than anticipated, and will not bite upon landing.

Figure 22:
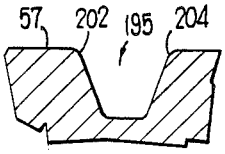
PRIOR ART FIG 22
FIG. 22 is an enlarged cross-section view of a box groove in the striking face of a conventional golf iron.
Figure 23:
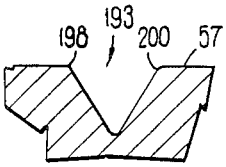
PRIOR ART FIG 23
FIG. 23 is an enlarged sectional view of a V-groove in the striking face of a conventional golf iron.

Conventionally, the horizontal grooves are for the purpose of channeling away water trapped between the golf ball and the striking face 57 from the point of impact and for providing a frictional surface to assure that back spin is imparted to the ball. Horizontal grooves in the prior art have been a groove 193 configured with a V cross-section as shown in FIG. 23 or a groove 195 configured with a box cross-section as shown in FIG. 22. Both prior art groove cross-sections have sharp junctions 198 and 200 where the V-shaped groove 193 intersects the striking surface 57 and junctions 202 and 204 where the box-shaped groove 195 joins the striking surface 57. Consequently, the sharp junctions 198, 200, 202, and 204 tend to scuff the ball as they impart back spin to the ball.

Figure 21:
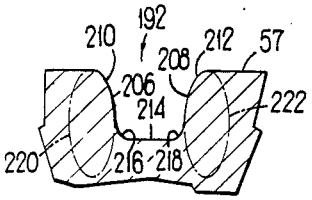
FIG. 21 is an enlarged cross-sectional view of a parabolic groove in the striking face of the #5 golf iron shown in FIG. 17.

Turning to FIG. 21, there is shown the cross-section of one of the horizontal grooves 192 formed in accordance with the present invention. The groove 192 in FIG. 21 has two sides 206 and 208 which join the striking face 57 at top junctions 210 and 212. The groove also has a planar bottom 214 which joins the sides 206 and 208 at bottom junctions 216 and 218. The top junctions 210 and 212 and the major portion of the sides 206 and 208 are defined by a parabola such as 220 for side 206 and top junction 210 and parabola 222 for side 208 and top junction 212. The bottom junctions 216 and 218 are defined by radii.

Figure 24:
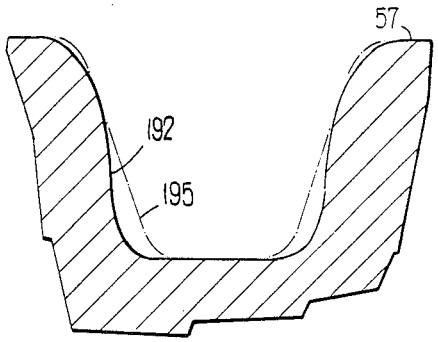
FIG. 24 is an enlarged cross-sectional view showing the conventional box-groove of FIG. 22 superimposed over the parabolic groove shown in FIG. 21.

As can be clearly seen in FIG. 24, when the conventional box groove 195 is superimposed over the parabolic groove 192 of the present invention, the area within the parabolic groove 192 is greater than that in the conventional box groove 195. Consequently, the parabolic groove 192 can direct more water away from the contact area between the ball and the striking face 57. Also, because the top junctions 210 and 212 are defined by a portion of a parabola, they are not sharp and therefore do not scuff the ball.

Figure 25:
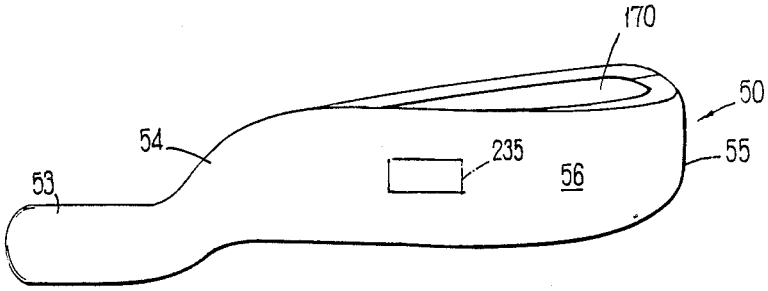
FIG. 25 is a bottom plan view of a #5 golf iron of the present invention.
Figure 26:
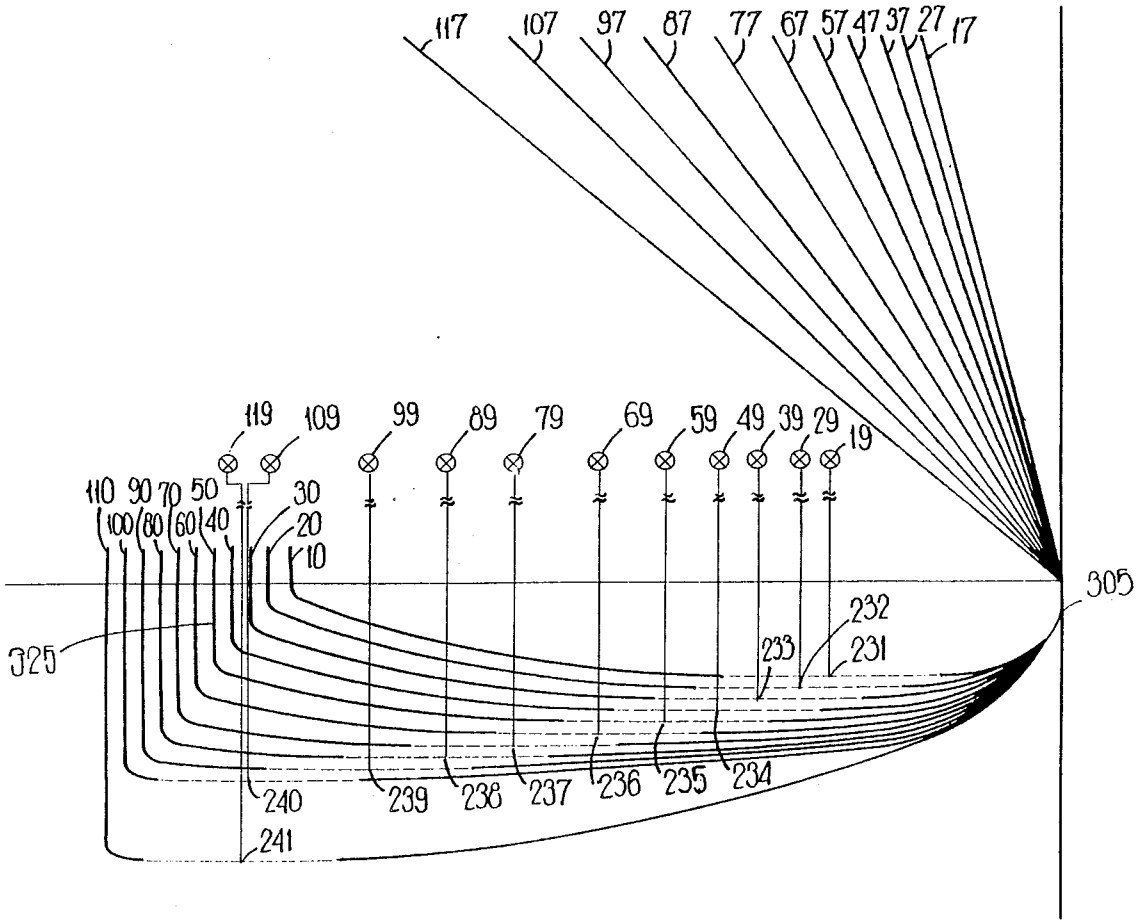
FIG. 26 is a schematic representation showing the sole profiles of the set of golf irons of the present invention.

In another aspect of the present invention, the sole of each golf iron is provided with a flat spot which causes the head to sit squarely when the golf iron is grounded at a dress. With reference to FIG. 25, the #5 iron 50 having a sole 56 has a flat spot 235 on the sole measuring approximately 0.5″×0.2″. While the size of the flat spot 235 is not particularly critical, I found that the placement along the length of the sole 57 is of some importance in assisting the golfer in properly grounding the club. With reference to FIG. 26, it can be seen that the flat spot 235 on the #5 iron is located approximately half-way between the leading edge 305 and the trailing edge 325. The flat spots 231–241 on the irons 10, 20, 30, 40, 50, 60, 70, 80, 90, 100, and 110 are progressively located between the leading edge and the trailing edge as shown in FIG. 26 in a vertical line with the centers of mass 19, 29, 39, 49, 59, 69, 79, 89, 99, 109, and 119.

I claim:

1. In a set of golf irons consisting of long irons and short irons wherein each iron has a head with a heel, a toe, a sole, a planar face, a backside, a top, a center of mass, and a hosel and wherein each iron has an offset and the set has progressively decreasing offset from the long irons to the short irons, the improvement comprising a progressively decreasing displacement from the long irons to the short irons.

2. The set of golf irons of claim 1, wherein each iron has a moment of inertia about its shaft axis which is equal within 17% to every other iron in the set.

3. The set of golf irons of claim 2, wherein the offset and displacement in inches are:

| Iron | Displacement | Offset |
|---|---|---|
| 1 | 1.5 | −0.103 |
| 2 | 1.4715 | −0.082 |
| 3 | 1.4433 | −0.061 |
| 4 | 1.3879 | −0.039 |
| 5 | 1.3336 | −0.018 |
| 6 | 1.3068 | +0.003 |
| 7 | 1.2804 | +0.024 |
| 8 | 1.2541 | +0.046 |
| 9 | 1.2282 | +0.076 |
| Pitching Wedge | 1.1769 | +0.088 |
| Sand Wedge | 1.1769 | +0.099 |

4. The set of irons of claim 1, wherein the face of each iron has a length and the face has a pattern of horizontal grooves including a number of full length grooves which extend across a majority of the length of the face and wherein the pattern has a pattern length defined by the full length grooves which pattern length is progressively shorter in the horizontal direction beginning with the long irons and progressing to the short irons.

* * * * *